United States Patent [19]

Terada et al.

[11] Patent Number: 4,568,254

[45] Date of Patent: Feb. 4, 1986

[54] TUBING PUMP

[75] Inventors: Kunio Terada; Junji Aoki, both of Kyoto, Japan

[73] Assignee: Horiba, Ltd., Kyoto, Japan

[21] Appl. No.: 618,362

[22] Filed: Jun. 7, 1984

[30] Foreign Application Priority Data

Jul. 6, 1983 [JP] Japan ..... 58-106260[U]

[51] Int. Cl.[4] ..... F04B 43/12; F04B 45/08

[52] U.S. Cl. ..... 417/475

[58] Field of Search ..... 417/475, 477

[56] References Cited

U.S. PATENT DOCUMENTS

| | | | |
|---|---|---|---|
| 3,116,697 | 1/1964 | Bilichniansky | 417/475 |
| 3,227,092 | 1/1966 | Clark | 417/475 X |
| 3,502,034 | 3/1970 | Pickup | 417/475 |
| 3,809,498 | 5/1974 | Lewis et al. | 417/477 X |
| 4,233,001 | 11/1980 | Schmid | 417/310 |

FOREIGN PATENT DOCUMENTS

| | | | |
|---|---|---|---|
| 577378 | 6/1959 | Canada | 417/477 |

*Primary Examiner*—Richard E. Gluck

*Attorney, Agent, or Firm*—Wenderoth, Lind & Ponack

[57] ABSTRACT

The present invention is concerned with a tubing pump used for conveying various kinds of fluids with a plurality of tubes different from each other in inner diameter and pressed by a rotating tube-pressing device. Each of the tubing parts of tubes to be pressed by the tube pressing device is connected to the remaining parts of the tube so as to be replaceable and to compose a tube unit in cooperation with the remaining parts. Relative position coordinating pins are provided for enabling correct replacement of tubing parts assembled into the tube unit to be pressed.

1 Claim, 4 Drawing Figures

TUBING PUMP

BACKGROUND OF THE INVENTION

1. Field of the Invention

The present invention relates to an improvement in the art to be applied to the tubing pump used for conveying various kinds of fluids. The present invention is provided with a plurality of tubes different from each other in inner diameter and disposed in parallel with each other over the length of the common axis of rotating bodies and, further, provided with tube pressing means disposed around the common axis of the above-said rotating bodies at fixed intervals so that fluids may be conveyed by pressing and squeezing action effected on tubing parts of the abovesaid tubes by the rotation of tube pressing means.

2. Description of the Prior Art

Conventional type tubing pumps have such a structure which often require replacement of tubes that have been deteriorated by squeezing action of the pressing means.

This structure, however, has a drawback in that the replacement of a single piece of the deteriorated tube by an unused one causes variation in fluid flow quantity only in the replacing tube and, as a result, unbalance in the total feed quantity of fluids. Yet, the replacement of all tubes every time when any of the tubes is deteriorated is uneconomical and the wrong connection of tubes is liable to be caused since a difference in inner diameter between tubes is quite small though tubes are primarily different from each other in inner diameter, thereby resulting in unsatisfactory performance of the pump as a whole.

SUMMARY OF THE INVENTION

The present invention is intended for reasonably eliminating the above-described drawback in the prior art and characterized in that, in a tubing pump as described earlier, a tubing part of the tube subjected to pressing action of a pressing means is replaceably connected to the remaining parts of the tube, both ends of the pressed part of the tube are fixed to a pair of blocks detachably fixed to the pump bracket so as to form a tube unit, and means for coordinating relative positions of blocks and brackets is provided between at least one of the abovesaid block and a bracket to which the block is fixed.

In other words, in a tubing pump according to the present invention, a single piece of the deteriorated tube is not replaced but, instead, the whole of the tubing part of the tube to be pressed is replaced and, therefore, no change occurs in the balance of the feed quantity of fluids. Further, the replacement of only the pressed part of the tube, not of the whole of the tube, is economical and the provision of relative position coordinating means entirely prevents the wrong connection of tubes. Thus, the drawback in the prior art is easily removed by a reasonable improvement as above.

As a preferred embodiment of the present invention, the abovesaid relative position coordinating means is composed of a pin and a pin insertion part. In this way, positioning means with a simple structure enables exact positioning of parts related to each other.

Other objects and effects of the present invention will be apparent from the following description.

BRIEF DESCRIPTION OF THE DRAWINGS

The drawings show an example of a tubing pump embodying the present invention, wherein.

DESCRIPTION OF THE PREFERRED EMBODIMENTS

An embodiment of the present invention will be described with reference to the drawings.

Figure 1:
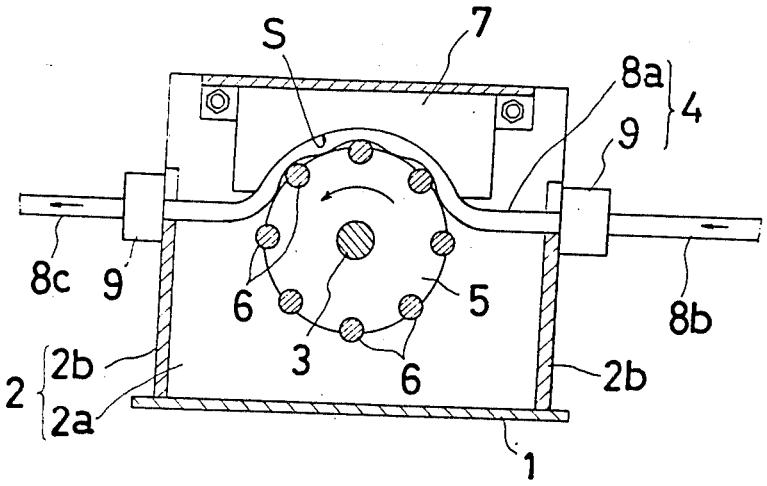
FIG. 1 is a vertical sectional view of a tubing pump.
Figure 2:
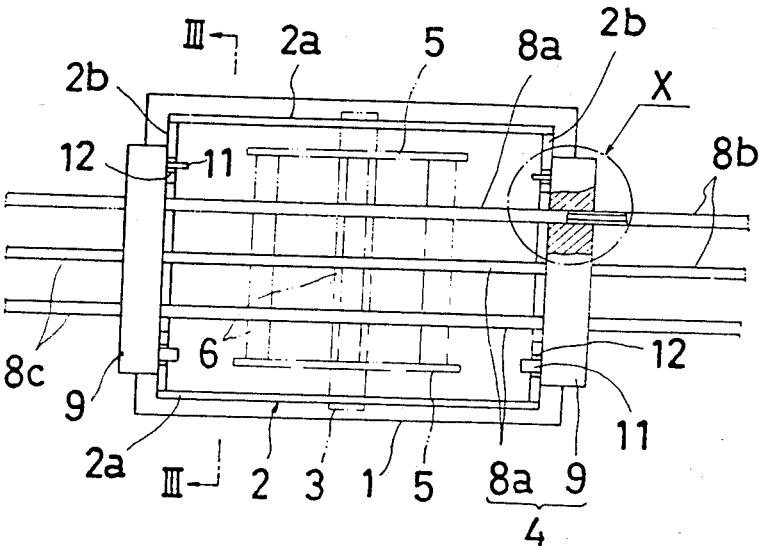
FIG. 2 is a schematic plan view thereof.
Figure 3:
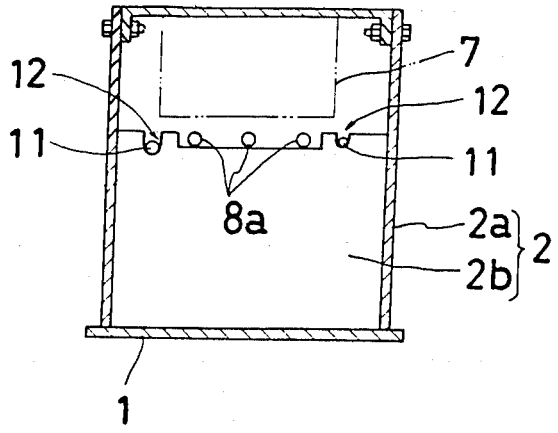
FIG. 3 is a sectional view thereof taken along the line III—III in FIG. 2; and, FIG. 4 is an enlarged view of a portion indicated as X in FIG. 2.

FIGS. 1 through 3, show a tubing pump housing a base, and a box-like bracket 2, respectively, and opposing parts 2*a* of the bracket 2 on one directional side bearingly support a rotating shaft 3 connected to and driven by a motor. A tube unit 4 is detachably connected to opposing parts 2*b* of the bracket 2 on the other directional side. The tube unit 4 will be described later in detail.

A pair of rotating disk-like bodies 5 are coaxially fixed to the abovesaid rotating shaft 3.

Tube pressing means 6 are, for example, rollers which are rotatably supported around the common axis of and between the abovesaid pair of rotating bodies 5 at fixed intervals.

A block 7 has a pressing surface S centered on the axis of the abovesaid rotating shaft 3; between the pressing surface S and pressing means 6, which are turned while rotating on axes thereof, a gap as wide as permitting insertion of tubing parts 8*a*, which will be described later, thereinto is formed; and the pressing block 7 is detachably fixed to the above-said opposing parts 2*a* of the bracket 2 on one directional side with bolts.

Figure 4:
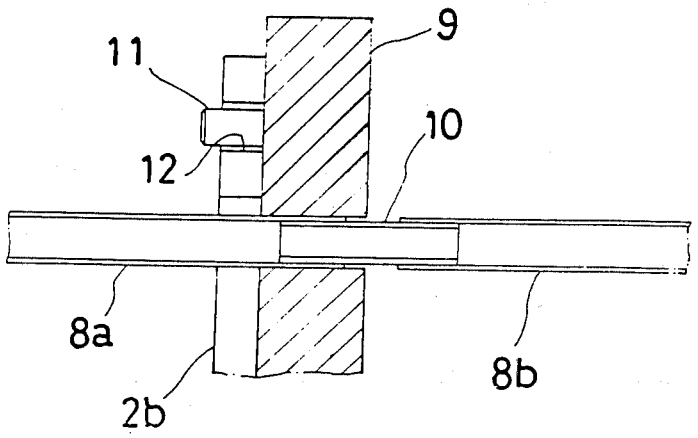

Now, the concrete structure of the abovesaid tube unit 4 will be described. This tube unit 4 comprises a plurality of tubing parts 8*a* different from each other in inner diameter and to be pressed by tube pressing means 6, and a pair of blocks 9 for fixing both ends of the tubing parts 8*a*. More particularly, as shown in FIG. 4, too, holes are provided on each of blocks 9 so as to pierce widthwise at fixed intervals in the lengthwise direction of the block, the tubing parts 8*a* which are pressed and individually inserted through the hole. Connecting tubes 10 are forcedly inserted into the tubing parts 8*a* and ends of the tubing parts 8*a* are fixed to the blocks 9.

For setting the tube unit 4 to the other brackets 2*b* a plurality of the abovesaid tubing parts 8*a* are disposed in parallel with each other over the length of the common axis of the rotating bodies 5 while the abovesaid tube pressing means 6 is being removed. A pair of blocks 9 are fixed to the brackets 2*b* with bolts, while the abovesaid tube pressing block 7 is fixed to the bracket 2. When using the pump in practice, tubing parts 8*b* and 8*c* are connected to ends of each tubing part 8*a* at the fluid feed side and discharge side, respectively.

After the tubing parts 8*b* and 8*c* at the feed side and the discharge side, respectively, are connected to each other and upon rotation of the rotating shaft 3 by a motor not shown in the drawing, disk-like rotating bodies 5 rotate and tube pressing means 6 rotate on the axis thereof and are turned around the axis of the rotating shaft 3 to squeeze the tubing parts 8*a*. Thereby liquids of various kinds are conveyed from the tubing parts 8*b* on the feed side to those tubing parts 8c on the discharge side.

According to the present invention, when the tubing parts 8a are deteriorated due to long term use, the whole of the abovesaid tube unit 4 is replaced by another unused unit 4 having the same characteristics as those of the replaced one.

For the purpose of preventing the wrong connection of tubes at the time of replacement of the tube unit 4, according to the present invention, position coordinating means 11 and 12, which are engageable with each other only when the tube unit 4 is correctly disposed, are provided on the above-said blocks 9 and brackets 2b. In the concrete embodiment of the present invention, position coordinating means 11 and 12 comprise two pins 11 dimensionally different from each other. Pin insertion parts 12 dimensionally corresponding to respective pins 11 and 11 are provided on the block 9 and the brackets 2b and 2b, respectively, whereby the tube unit 4 cannot be set unless put in correct positions, that is to say, there is no room for causing a wrong connection of the tubes.

A structure for relative position coordinating means 11 and 12 is capable of being modified in various ways, and the provision of at least a pair of these means between at least one of the blocks 9 and a bracket 2b to which the block 9 is fixed may satisfy the purpose of the present invention.

We claim:

1. A tubing pump comprising:

a housing having a base, two opposing side walls, two opposing end walls, and a top, said top having an underside;

a plurality of tubes passing lengthwise through the housing;

a shaft mounted in the sidewalls crosswise in the housing;

a rotating disk-like body being mounted on the shaft and having a circumferential periphery;

means, mounted on the circumferential periphery for pressing the plurality of tubes;

a block having a pressing surface and being mounted to the underside of the top of the housing for allowing the plurality of tubes to be pressed by the pressing means against the pressing surface of said block;

a further block mounted on an outer side of each of the two opposing end walls for receiving the plurality of tubes lengthwise in the housing;

two different sized pins mounted on each further block for securing each further block in a set orientation to the two opposing end walls of the housing; and complementary sized openings being arranged in the two opposing end walls of the housing, said openings having different dimensions properly corresponding to the different sized pins for receiving the pins;

whereby the further blocks and tubes can only be inserted in the housing in a predetermined position.

* * * * *